United States Patent [19]

Kiyooka

[11] Patent Number: 4,663,799

[45] Date of Patent: May 12, 1987

[54] DUST COLLECTOR

[75] Inventor: Katsumi Kiyooka, Warabi, Japan

[73] Assignee: Komatsu Zenoah Co., Higashiyamato, Japan

[21] Appl. No.: 821,686

[22] Filed: Jan. 23, 1986

[30] Foreign Application Priority Data

Jan. 23, 1985 [JP] Japan ..... 60-009189

[51] Int. Cl.[4] ..... A47L 5/14

[52] U.S. Cl. ..... 15/330; 15/344; 15/405

[58] Field of Search ..... 15/330, 344, 405

[56] References Cited

U.S. PATENT DOCUMENTS

| | | | |
|---|---|---|---|
| 2,026,291 | 12/1935 | Tirimacco | 56/23 |
| 2,863,525 | 12/1958 | Lucian | 183/37 |
| 3,704,482 | 12/1972 | Brannon | 15/348 |
| 3,808,631 | 5/1974 | Shibata et al. | 15/321 |
| 3,922,753 | 12/1975 | Aberilla | 15/409 |
| 4,290,165 | 9/1981 | Hiramatsu et al. | 15/330 |
| 4,318,203 | 3/1982 | Satoh et al. | 15/344 |
| 4,387,852 | 6/1983 | Mattson et al. | 239/143 |
| 4,403,371 | 9/1983 | Kiyooka | 15/328 |
| 4,451,951 | 6/1984 | Satoh | 15/405 X |

*Primary Examiner*—Chris K. Moore

*Attorney, Agent, or Firm*—Thompson, Birch, Gauthier & Samuels

[57] ABSTRACT

Dust collection apparatus is disclosed adapted for both vacuuming and blowing/sweeping functions. The apparatus consists of a single, self-contained unit comprising a blower, a cleaning hose, an engine, a collecting area, inlet and outlet passages, and a switching valve which can switch the internal airflow so as to convert the cleaning hose from a vacuuming function to a blowing/sweeping function.

1 Claim, 6 Drawing Figures

DUST COLLECTOR

BACKGROUND OF THE INVENTION

1. Field of the Invention

This invention relates to a dust collector and in particular to the collection area which collects dust which is drawn in by the blower.

2. Description of the Related Art

Conventionally in dust collectors of this type, for example as shown in FIG. 1, cleaning hose 9 is connected by way of joint 7 to blow pipe 5 which is connected to discharge opening 3 of blower 1. The confluent air flow is then sent to the collection area 11 comprised of a dust bag. The air discharged from blower 1, which is driven by the engine, enters the collection area 11. Air travelling through joint 7 causes air to be drawn in through cleaning hose 9. The dust which is drawn in through the end of the cleaning hose is collected in the collection area 11. FIG. 2 shows a second example of the conventional equipment. Dust drawn in by blower 1 enters through the end of cleaning hose 9 and is drawn through inlet opening 13. The dust is then collected in collection area (collection bag) 11 through discharge opening 3. Air is released to the atmosphere through the cloth of the bag. FIG. 3 shows a third example of the conventional equipment. Dust is drawn in through the end of cleaning hose 9 and is collected in collection area 11 by wire mesh 15. Air is drawn in through inlet opening 13 of blower 1 and is released to the atmosphere through discharge opening 3.

In conventional dust collectors, changing from drawing in dust through cleaning hose 9 to blowing air through the cleaning hose 9, for example in blowing and gathering fallen leaves, it was necessary to exchange the cleaning hose 9. This exchange is very troublesome. In the example of FIG. 1, joint 7 is removed and cleaning hose 9 is directly connected to discharge opening 3 or blow pipe 5, causing air to be blown from cleaning hose 9. In the example of FIG. 2 and FIG. 3, collection portion 11 is removed from blower 1 and cleaning hose 9 is connected to the discharge opening 3 of blower 1, as shown in FIG. 4, causing air to be blown out.

SUMMARY OF THE INVENTION

The problem is solved according to the invention in that in the dust collector is disposed a collection area which is connected to the inlet opening of the inlet pipe to collect dust that is drawn in by a cleaning hose. In this invention is a switching valve which can switch the cleaning hose either to the inlet passage connected to the collection area or to the discharge passage connected to the discharge opening of the blower with the other closed. Also in the invention is an opening-closing valve which opens the inlet passage to the atmosphere when the cleaning hose is connected to the discharge passage. Also a portion of the discharge from the blower is branched off and made to go around the outside of the cylinder of the engine which drives the blower.

DESCRIPTION OF THE PREFERRED EMBODIMENT

Below is a detailed description based on the drawings of a first embodiment of the invention.

Figure 5:
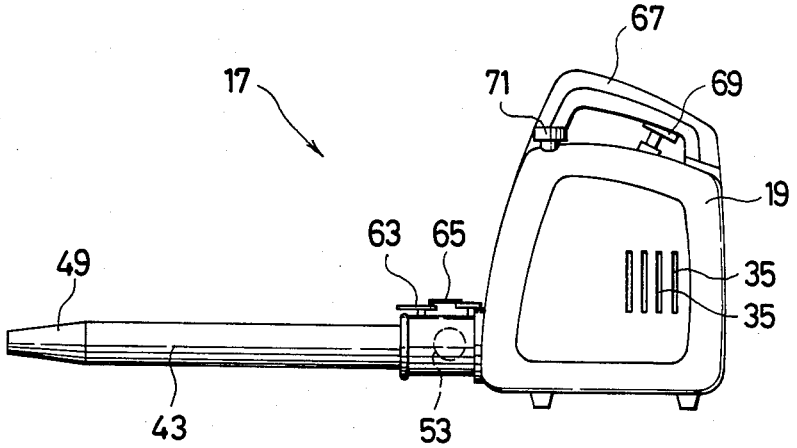
FIG. 5 is a side view of a first embodiment of the present invention.
Figure 6:
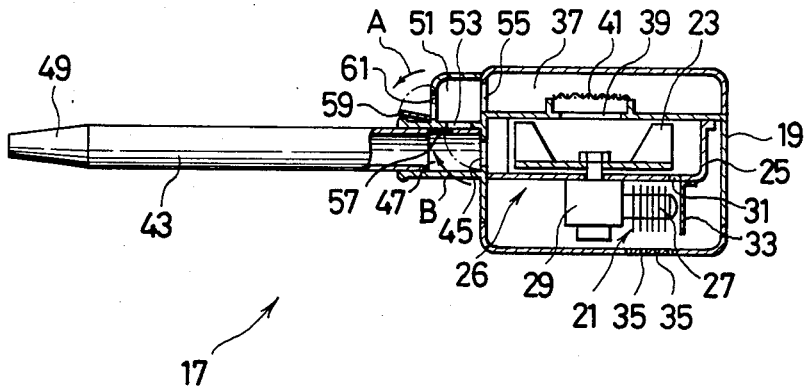
FIG. 6 is a sectional view.

The portable dust collector 17 as shown in FIG. 5 and FIG. 6 is comprised of the following construction. Disposed in main casing 19 is blower 26, which is composed of fan 23 which is driven by engine 21, and swirl type fan case 25 which covers fan 23. Cylinder 27 is attached to crank case 29 of engine 21. Air hole 31 is an opening in fan case 25 and joins the high pressure section of fan case 25 and the outer peripheral section of cylinder 27. Cover 33 guides the air blown through air hole 31 around cylinder 27. Exhaust holes 35 are openings in main casing 19 through which air flowing around the cylinder 27 is discharged. Collection area 37 joins fan case 25 and is communicated with inlet opening 39 of fan 23 by way of filter 41. Cleaning hose 43 is connected to discharge opening 45 of fan case 25 by way of discharge passage 47. On the end of cleaning hose 43, nozzle 49 is disposed. Inlet passage 51 crosses discharge passage 47 and branches off at opening 53 and is communicated at dust inlet opening 55 with the collection area 37. Switching valve 57 switches between the discharge opening 45 and opening 53 for closing. Opening-closing valve 59 opens or closes opening 61 which communicates inlet passage 51 to the atmosphere. Switching lever 63 is used so that switching valve 57 and opening-closing valve 59 are sequentially operated by way of link 65 to open the communication between the inlet passage 51 and the atmosphere when the cleaning hose 43 is connected to the discharge passage 47, and to close the communication between the inlet passage 51 and the atmosphere when the cleaning hose 43 is connected to the inlet passage 51. Disposed on the outside of the main casing 19 is handle 67, starter handle 69 and fuel tank cap 71.

Figure 1:
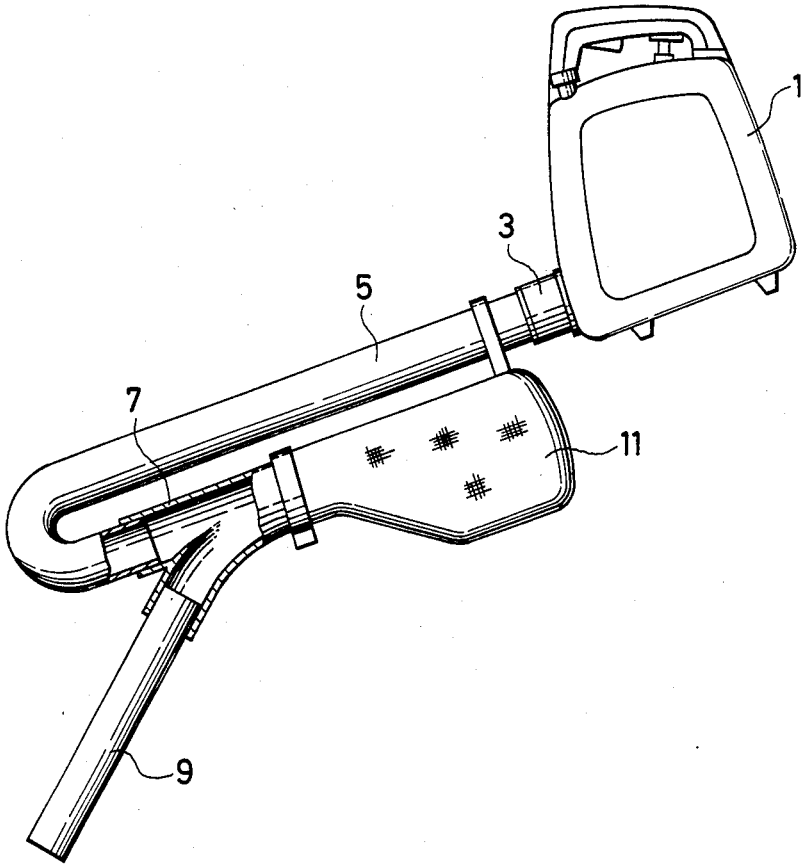
FIG. 1 RELATED ART
FIG. 1 is a sectional side view of conventional equipment.
Figure 2:
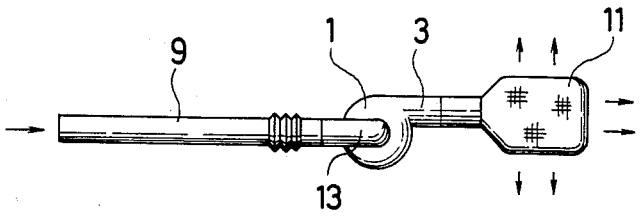
FIG. 2 RELATED ART
FIG. 2 is a view explaining the air flow of a use embodiment of the example of FIG. 1.
Figure 3:
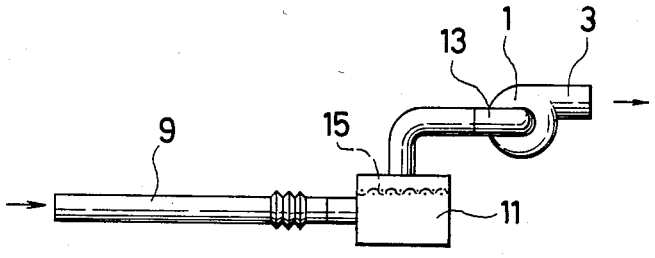
FIG. 3 RELATED ART
FIG. 3 is a view explaining the air flow of another use embodiment of the example of FIG. 1.
Figure 4:
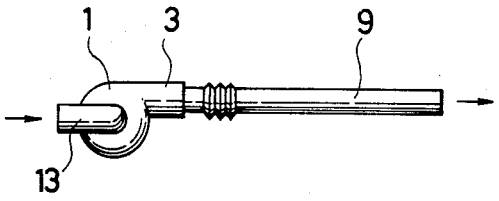
FIG. 4 RELATED ART
FIG. 4 is a view explaining the air flow of another use embodiment of the example of FIG. 1.

In the above example, when opening-closing valve 59 is opened in the direction shown by arrow A in FIG. 2, and switching valve 57 closes opening 53 in the direction shown by arrow B, air is drawn in through opening 61 by fan 23. This air passes through inlet passage 51 and inlet 55 and enters the collection area 37. A portion of this air goes through air opening 31 and is made to go around cylinder 27 and then is discharged to the atmosphere through exhaust holes 35. The remaining portion of air passes through discharge opening 45, discharge passage 47, and cleaning hose 43 and then is blown out through nozzle 49. The air blown out can be used to gather up fallen leaves. To draw in dust, opening-closing valve 59 is moved in the opposite direction of arrow A of FIG. 2 to close opening 61, and switching valve 57 is moved in the opposite direction of arrow B to close discharge opening 45 by way of lever 63. Dust then enters nozzle 49 along with the air and is drawn through cleaning hose 43. It then passes through opening 53 and inlet passage 51 and enters collection area 37 from opening 55. The dust is collected at filter 41 and the air passes through opening 31 and around cylinder 27 and released to the atmosphere through exhaust holes 35.

This invention having the construction of that outlined in the claims can perform dust collection and gathering without exchanging the cleaning hose but uses a simple switching process which improves the efficiency of cleaning. Also when drawing in dust, if the filter is clogged, because the discharge opening is closed, air passing through the filter passes through opening 31 and around the cylinder to cool it, thereby preventing the engine from overheating.

In this invention by switching using the switching valve and opening-closing valve without the replacement of the cleaning hose, dust may be drawn in or air can be blown out so as to gather dust.

This invention is not limited by the aforementioned example or other examples. Also the description of the claims does not restrict the technical scope of the invention.

I claim:

1. A dust collector comprising a blower having an inlet opening and a discharge opening, a cleaning hose, an engine having a cylinder for driving said blower, a collection area which is communicated with said inlet opening to collect dust that is drawn in by said cleaning hose, an inlet passage communicated with said collection area, a discharge passage communicated with said discharge opening, a switching valve which can switch and connect said cleaning hose to one of said inlet passage and said discharge passage with the other closed and an opening-closing valve which opens said inlet passage 51 to the atmosphere when said cleaning hose is connected to said discharge passage wherein, a portion of the discharge air from said blower 26 is branched off and made to go around the outside of said cylinder of said engine.

* * * * *